US007225507B2

(12) United States Patent
Anderson et al.

(10) Patent No.: US 7,225,507 B2
(45) Date of Patent: Jun. 5, 2007

(54) SOCK SNAPS

(76) Inventors: Carroll L. Anderson, 2363 Wescreek Dr., Maryland Hts., MO (US) 63043-4111; Neeta Shahapeti, 12201 Glenpark Dr., Maryland Hts., MO (US) 63043

( * ) Notice: Subject to any disclaimer, the term of this patent is extended or adjusted under 35 U.S.C. 154(b) by 0 days.

(21) Appl. No.: 10/962,281

(22) Filed: Jan. 27, 2005

(65) Prior Publication Data

US 2005/0144765 A1 Jul. 7, 2005

Related U.S. Application Data

(60) Provisional application No. 60/517,484, filed on Nov. 5, 2003.

(51) Int. Cl.
*A44B 21/00* (2006.01)

(52) U.S. Cl. ..... 24/329; 24/331; 24/336; 24/339

(58) Field of Classification Search ..... 24/487, 24/499, 507, 508, 3.11, 3.12, 30.5 R, 66.8, 24/66.13, 298, 517, 518, 338, 329, 335, 493, 24/571, 545, 570, 300, 301, 336, 339, 341, 24/30.5, 557, 553, 563, 330–333; 223/85, 223/88–91, 93, 96; D8/395
See application file for complete search history.

(56) References Cited

U.S. PATENT DOCUMENTS 5,440,791 A * 8/1995 Guio ..... 24/545

* cited by examiner

*Primary Examiner*—Jack W. Lavinder

(57) ABSTRACT

The invention comprises a clip device that will separately hold each of a pair of clothing items, one to each side of the unit, during a mechanical laundry activity or while in storage. The purpose of the product is to prevent loss of either of a pair of small clothing items such as a mated pair of socks. The clip device has a left and a right separately hinged top section, with the hinges near the middle, which permits each top section to be separately raised for the placing of the clothing item. Each top section then is snapped closed using a separate lock and release mechanism on each side. Each side of the clip device has cone shaped grippers protruding in an alternating pattern from both the top and bottom sections to hold the item securely during the mechanical washing and drying of socks.

4 Claims, 2 Drawing Sheets

SOCK SNAPS

CROSS REFERENCE TO RELATED APPLICATIONS

This application claims priority benefit from U.S. Provisional Patent Application Ser. No. 60/517,484 filed on Nov. 5, 2003.

BACKGROUND OF THE INVENTION

Various products are known which serve to clip multiple clothing items together for such diverse applications as hanging on a display rack, and for holding a matched pair of socks together during washing and drying. Several prior art products for clipping socks together are single clip designs that hold a pair of socks jointly bound in each unit with one sock atop the other. Another type of existing product is a hook and eye design fastened on each sock to attach the socks together.

Design flaws are inherent in such known products, such as limited ability to hold wet cotton and other materials securely during washing machine wash and rinse cycles, and during drying in mechanical drying machines, while permitting thorough washing and drying of each item. The known product designs are further limited by difficulty of getting wet or dry socks in and out of the unit. Other designs of products for similar use have flaws such as inability of both socks to be thoroughly washed or completely dried in a mechanical washer or dryer.

Accordingly, it is desirable to provide a device for securely holding a matched pair of socks during washing and drying operations, while permitting thorough washing and drying of each item, and that provides for easy sock insertion and removal.

BRIEF SUMMARY OF THE INVENTION

There is, therefore, provided in the practice of the invention a device for securely holding and separating apart paired articles of clothing, such as socks, during washing and drying operations, while permitting thorough washing and drying of each item, easy insertion and removal of said items, and to prevent the loss or miss-mating of the paired articles of clothing, such as socks, during the wash and dry laundry activity or during storage of mated articles while not in use. The foregoing needs are met, to a great extent, by the present invention, wherein in one aspect a sock snaps device is provided that is a plastic molded material having moveable sections on the top that are adapted to a middle separating section to permit a rising top member on each side, left and right. Each top member also has protruding gripper members on the underside to provide retention of the sock in the sock snaps unit. The bottom section of the sock snaps unit comprises a solid bar with gripper members protruding upward alternating with the gripper members of the moveable top members. The end of each of the left and right sock snaps top members includes a lock or latch member that engages a mating receptacle section in the base member to lock and release the moveable top member in order to raise and lower the movable top member for insertion and removal of the socks. The hinged top member makes sock insertion and removal an easy task. The separation of each sock to a left or right side makes thorough washing and drying possible in a mechanical washer or dryer. The material of construction (plastic molding) is selected to permit the drying of socks in a mechanical dryer.

Accordingly, there has thus been outlined, rather broadly, a single sock snaps unit that will hold the two socks of a pair of socks, one to each side of the unit, and that will provide secure retention of socks during the mechanical washing and rinsing of socks in an automatic washer, and the drying of socks in a mechanical dryer.

BRIEF DESCRIPTION OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
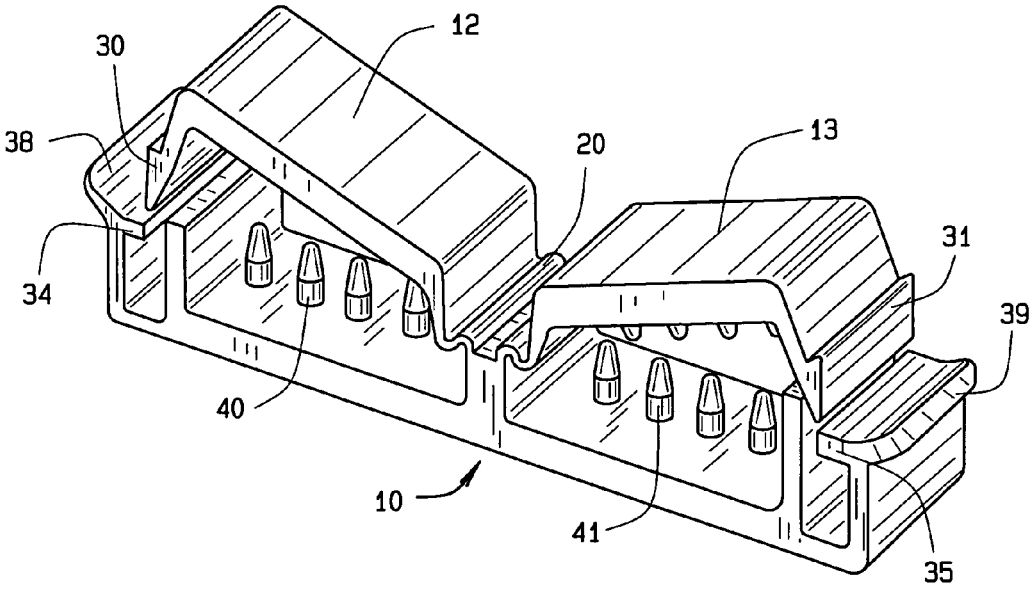
FIG. 1 is an upper perspective side view illustrating a sock snap device according to a preferred embodiment of the invention, with the clip members in open position.

The invention will now be described with reference to the drawing figures, in which like reference numerals refer to like parts throughout. For purposes of clarity in illustrating the characteristics of the present invention, proportional relationships of the elements have not been maintained in the Figures. Instead, the sizes of certain small components have been exaggerated for illustration.

Figure 2:
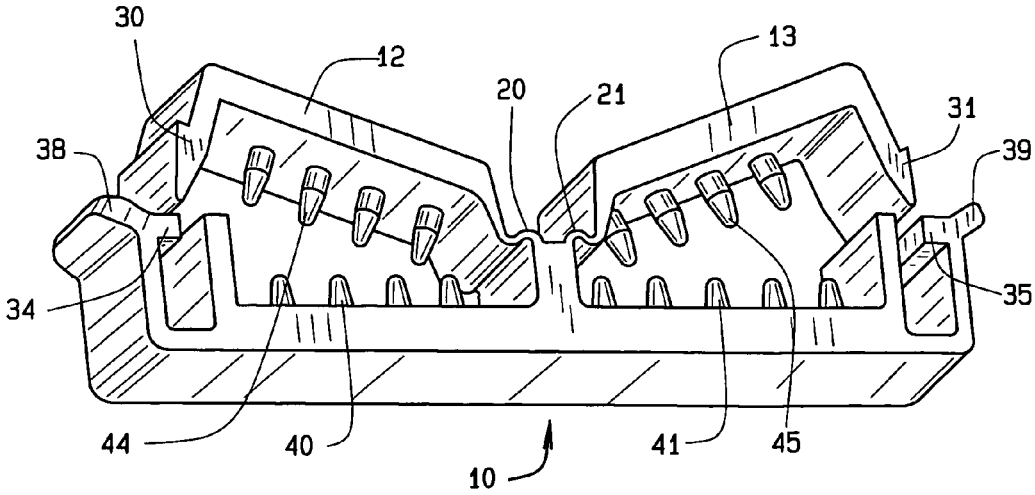
FIG. 2 is a lower perspective side view of the sock snap device of FIG. 1.

An embodiment in accordance with the present invention provides, as shown in FIG. 1, a molded plastic clip device 10 suitable for both water emersion and dryer heating. The sock snaps device has two moveable top members 12 and 13 located on either side of the device, to permit 'loading' and 'unloading' of one sock per side when the top members are in open position as shown in FIG. 1 and FIG. 2. Each top member includes a molded flexible hinge member at the top center of the device, shown as 20 and 21 in FIG. 2. The outer ends of top members 12 and 13 are angled vertically downward at approximately 90 degrees from the plan of said top members with the terminal ends molded in a "V" configuration having an extended horizontal edge, 30 and 31, for latching retention in receiving clips 34 and 35 molded into each end of the base of the device. The receiving clips include molded wings 38 and 39 whereby the receiving clips 34 and 35 can be released by thumb pressure by the user.

Figure 3:
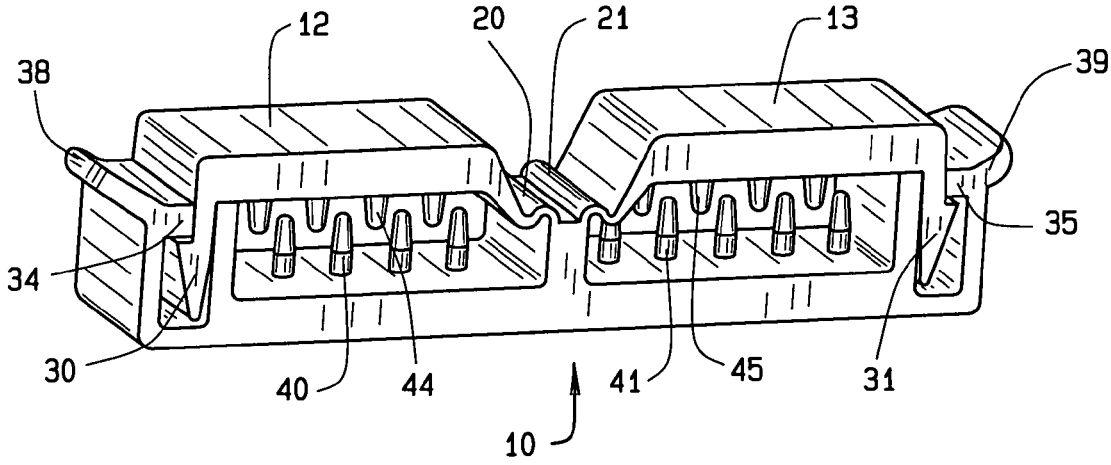
FIG. 3 is a side view of the sock snap device according to a preferred embodiment of the invention, showing the clip members in closed position.

In order for the clip device 10 to securely hold each of a pair of socks or other clothing items, each of the top members and the base of the device has alternating internally facing gripper members, 44, 45, 40 and 41 as shown in FIG. 2 and FIG. 3, to secure each sock to the left and right side of the sock snap device; thus providing for thorough washing and drying of a pair of socks in a mechanical washer and dryer. It is anticipated that by clipping single socks in this manner that drying time will be reduced relative to prior art products where two socks are overlapped in a single clip.

In a preferred embodiment the gripper members 40, 41, 44, 45, as shown in FIG. 2 and FIG. 3, have rounded tips and will not stretch, snag, or otherwise alter the material of socks when the top members 12 and 13 are in closed position as shown in FIG. 3. The gripper members 40, 41, 44, 45, will permit secure retention of each sock during the wet stage of washing and the heat stage of drying. The latch assembly, see FIG. 3 (30, 34, 38, and 31, 35, 39), of the sock snaps device will securely hold the matched socks together so that one of a pair is not "lost" or misplaced in the laundry cycle. Said latch assembly is sufficiently flexible to permit a human user to unsnap the latch members 30 and 31 by exerting thumb pressure on wings 38 and 39 to remove either sock at any time, but will remain fastened during the movement of a mechanical washer or dryer.

In one embodiment of the invention, the sock snaps device 10 is approximately 2.88"×0.55"×0.6" in the closed position as shown in FIG. 3. The sock snaps device of the invention is capable of holding any paired or non-paired clothing or pliable items with a total weight of less than four ounces that can be fastened and held between the gripper members of the device without causing damage to the held material. For retention of larger paired or non-paired clothing items, clip device 10 can be similarly produced in a larger size.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

We claim:

1. A device molded as a single unit for retaining a pair of clothing items during washing and drying comprising:

(a) two moveable top members, each top member having a flexible hinge member connected to the top center of the device, (b) each top member having outer ends angled vertically downward, said outer ends further including a horizontal latching extension, and (c) two receiving clips at each end of the device capable of engaging the latching extension of the moveable top members, said receiving clips further including molded wings capable of engagement by a user to release the latching extensions of the moveable top members, and (d) alternating internally facing gripper members extending downward from the underside of each of the moveable top members, and upward from the base of the device.

2. The device according to claim 1 wherein the alternating internally facing gripper members extending downward from the underside of each of the moveable top members, and upward from the base of the device are conical shaped gripper members having rounded tips.

3. The device according to claim 1 molded as a single unit from a pliable plastic material that is capable of withstanding the temperature conditions of laundry washing and drying machines.

4. The device according to claim 3 wherein the device with the top members in closed position is about 2.88 inches long, about 0.55 inch wide, and about 0.6 inch high, said device being capable or retaining clothing items weighing up to about 4 ounces.

* * * * *